US008106872B2

(12) United States Patent
Tsai et al.

(10) Patent No.: US 8,106,872 B2
(45) Date of Patent: Jan. 31, 2012

(54) IMAGE DISPLAY SYSTEM AND METHOD

(75) Inventors: Chia-Yi Tsai, Taipei (TW); Ya-Chuan Tsai, Taipei (TW)

(73) Assignee: Chimei Innolux Corporation, Chu-Nan (TW)

( * ) Notice: Subject to any disclaimer, the term of this patent is extended or adjusted under 35 U.S.C. 154(b) by 1065 days.

(21) Appl. No.: 11/968,572

(22) Filed: Jan. 2, 2008

(65) Prior Publication Data

US 2008/0165102 A1 Jul. 10, 2008

(30) Foreign Application Priority Data

Jan. 8, 2007 (TW) ..... 96100676 A

(51) Int. Cl.
*G09G 3/36* (2006.01)

(52) U.S. Cl. ..... 345/99; 345/102

(58) Field of Classification Search ..... 345/204–215, 345/73–104, 690–699
See application file for complete search history.

(56) References Cited

U.S. PATENT DOCUMENTS

| | | | | |
|---|---|---|---|---|
| 5,232,634 | A * | 8/1993 | Sawada et al. | 252/584 |
| 7,106,276 | B2 * | 9/2006 | Akiyama | 345/39 |
| 7,629,988 | B2 * | 12/2009 | Chung et al. | 345/694 |
| 2006/0007112 | A1 * | 1/2006 | Park | 345/102 |
| 2007/0057901 | A1 * | 3/2007 | Chino | 345/102 |
| 2007/0182682 | A1 * | 8/2007 | Hong et al. | 345/88 |

FOREIGN PATENT DOCUMENTS

JP 2004138827 A * 5/2004

* cited by examiner

*Primary Examiner* — Alexander Eisen
*Assistant Examiner* — Patrick F Marinelli
(74) *Attorney, Agent, or Firm* — Birch, Stewart, Kolasch & Birch, LLP

(57) ABSTRACT

An image display system includes a white-light source, a green-light source and a plurality of pixels. The white-light source generates white light during a frame time, and the green-light source generates green light during the frame time. Each pixel has a red sub-pixel, a blue sub-pixel and a white sub-pixel.

15 Claims, 9 Drawing Sheets

IMAGE DISPLAY SYSTEM AND METHOD

CROSS REFERENCE TO RELATED APPLICATIONS

This Non-provisional application claims priority under 35 U.S.C. §119(a) on Patent Application No(s). 096100676 filed in Taiwan, Republic of China on Jan. 8, 2007, the entire contents of which are hereby incorporated by reference.

BACKGROUND OF THE INVENTION

1. Field of Invention

The invention relates to an image display system and an image display method, and, in particular, to an image display system having a light source and an image display method of controlling the light source.

2. Related Art

An active matrix liquid crystal display (LCD) apparatus has been widely applied to an image display system due to its low power consumption, small thickness and better color displaying properties.

A LCD apparatus mainly includes a thin-film transistor (TFT) substrate, a liquid crystal layer and a color filter substrate. A plurality of pixels is also defined in the LCD apparatus. Each pixel includes red, green and blue sub-pixels. The color filter substrate has a plurality of red, green and blue filter layers respectively serving as portions of the red, green and blue sub-pixels. The TFT substrate has a plurality of pixel electrodes and a plurality of TFTs serving as switches. The color filter substrate has a common electrode. The pixel electrode and the common electrode form a liquid crystal storage capacitor. The TFT is driven by a scan line driving circuit so that a data line driving circuit can write data into the liquid crystal storage capacitor to control liquid crystals in the liquid crystal layer to rotate.

A backlight module uses a white-light source, such as a cold cathode fluorescent lamp (CCFL) or a white-light diode. The white light passes through a polarizer on the TFT substrate, the liquid crystal layer having the liquid crystals controlled to rotate, various color filter layers with different colors, and a polarizer on the color filter substrate so that different colors may be represented and an image may be generated.

Generally speaking, as shown in FIG. 1, the national television system committee (NTSC) ratio of the LCD apparatus is about 70%. Herein, the NTSC ratio represents the ratio of the gamuts that can be displayed by the LCD apparatus based on the conventional cathode ray tube (CRT) display under the CIE 1931 specification. That is, the CRT display corresponds to the NTSC ratio of 100%. As the NTSC ratio gets higher, the display ability is closer to that of the conventional CRT display and more colors may be represented, and the displayed color thereof is also closer to the true color of the original object, and the image quality is thus better and less distortion may occur.

In the LCD apparatus, however, the white light passing through the green filter layer cannot approach the pure green color so that the NTSC ratio cannot be easily enhanced, and the image quality cannot be effectively enhanced. In order to increase the NTSC ratio to enhance the image quality, the thickness of the filter layer is increased in the prior art so that the white light after being filtered can be closer to the pure color of the filter layer. Consequently, the image brightness is lowered although the NTSC ratio is increased. Thus, the image quality cannot be effectively enhanced.

Therefore, it is an important subject to provide an image display system and an image display method to solve the above-mentioned problems.

SUMMARY OF THE INVENTION

In view of the foregoing, the invention is to provide an image display system and an image display method in order to enhance a NTSC ratio and thus to represent the better color.

In addition, the invention is also to provide an image display system and an image display method in order to enhance the brightness of the image.

To achieve the above, the invention discloses an image display system, which includes a white-light source, a green-light source and a plurality of pixels. The white-light source generates white light during a frame time, and the green-light source generates green light during the frame time. The pixels are disposed corresponding to the white-light source and the green-light source, and each pixel has a red sub-pixel, a blue sub-pixel and a white sub-pixel.

To achieve the above, the invention also discloses an image display method including the steps of: generating white light passing through a red sub-pixel, a blue sub-pixel and a white sub-pixel of a plurality of pixels during a frame time, and generating green light passing through the white sub-pixel of the pixels to form an image during the frame time.

As mentioned above, the generated white light passes through the red, blue and white sub-pixels but the generated green light cannot pass through the red and blue sub-pixels but only can pass through the white sub-pixel during the same frame time in the image display system and method according to the invention. Thus, the insufficiently pure color of the green light can be compensated so that the formed image has the higher NTSC ratio and the better color can be displayed. In addition, the brightness of the image may also be increased so that the better display effect can be achieved.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
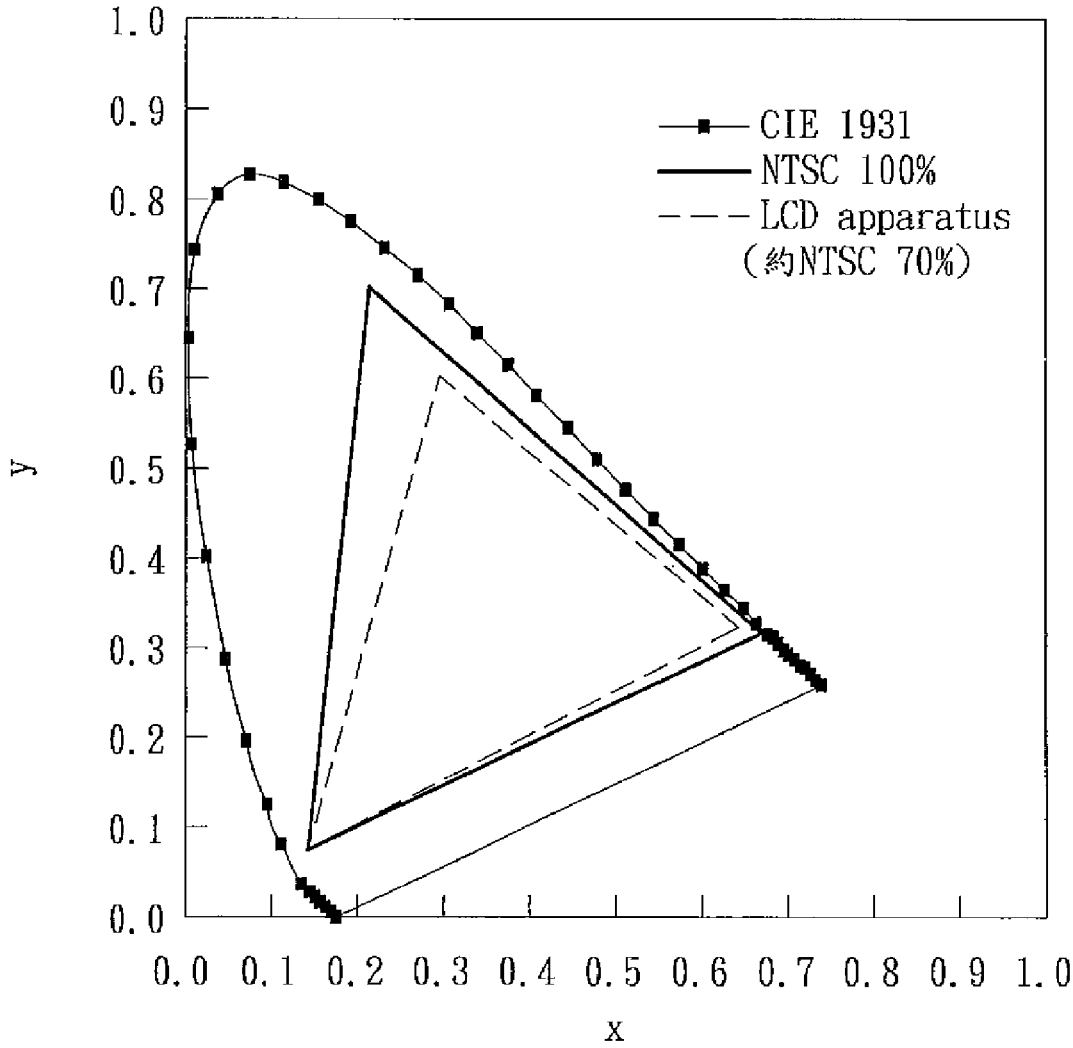
(PRIOR ART) FIG. 1
FIG. 1 shows a chromaticity diagram of a conventional LCD apparatus.
Figure 2:
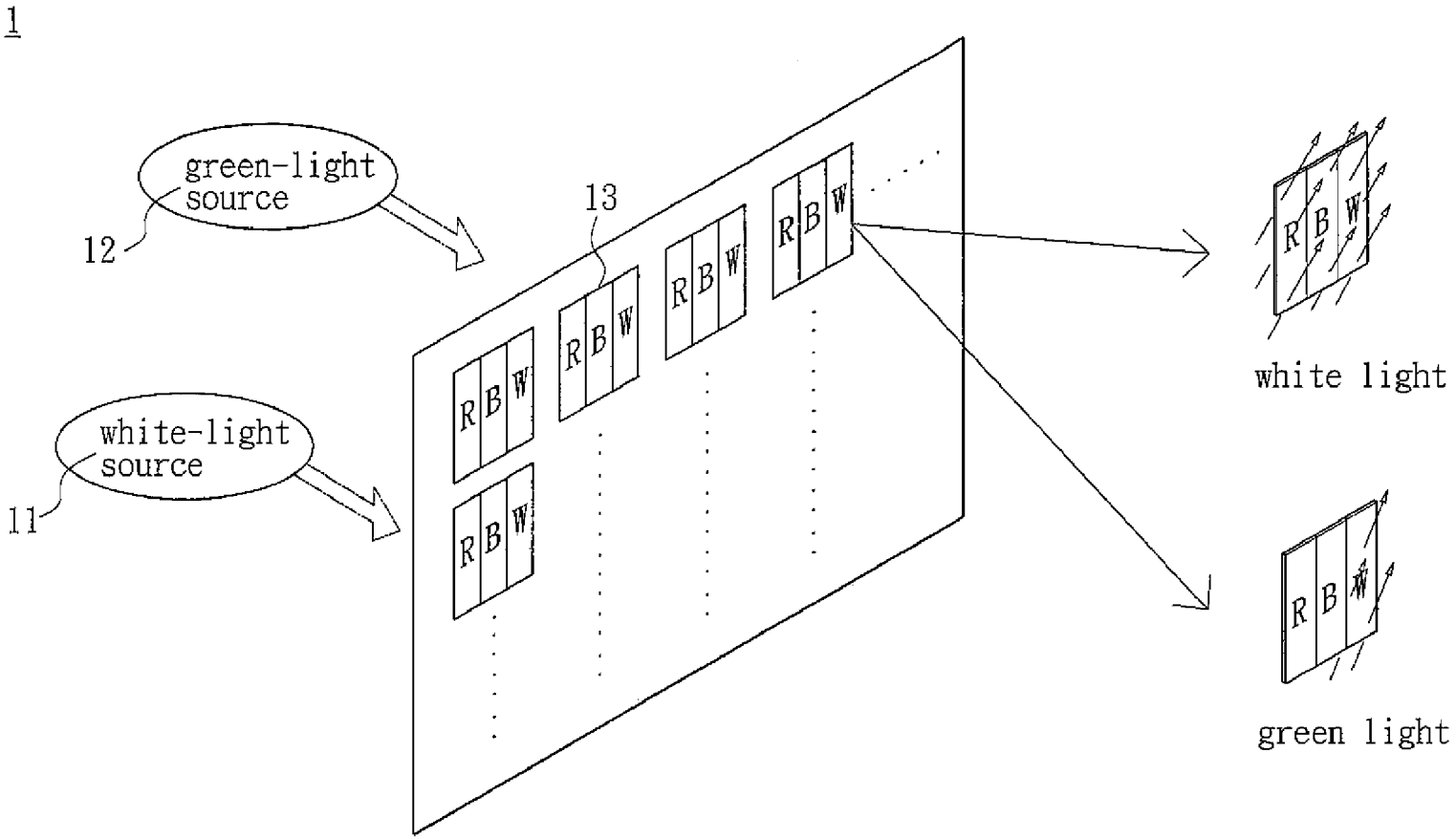
FIG. 2 is a schematic illustration showing an image display system according to a preferred embodiment of the invention.

FIG. 2 is a schematic illustration showing an image display system 1 according to a preferred embodiment of the invention. Referring to FIG. 2, the image display system 1 includes a white-light source 11, a green-light source 12 and a plurality of pixels 13. The white-light source 11 generates white light during a frame time. The green-light source 12 generates green light during the frame time. Each pixel 13 has a red sub-pixel R, a blue sub-pixel B and a white sub-pixel W. The white light and the green light may pass through the red sub-pixel R, the blue sub-pixel B and the white sub-pixel W. The white light passing through the red sub-pixel R, the blue sub-pixel B and the white sub-pixel W, and the green light passing through the white sub-pixel W form an image.

In this embodiment, light source switching operations are made in correspondence with operations of switches of the pixels during the frame time. For example, the red sub-pixel R, the blue sub-pixel B and the white sub-pixel W are turned on while the white-light source 11 generates the white light so that the red light, the blue light and the white light are obtained. The red sub-pixel R and the blue sub-pixel B are turned off and only the white sub-pixel W is turned on while the green-light source 12 generates the green light. Thus, when the green-light source 12 operates, the purer green light may be generated. Consequently, if the frequency of switching between the white-light source 11 and the green-light source 12 is sufficiently high, the switching time is shorter than the time of persistence of vision of the human eyes. Thus, a fixed image may be generated according to this method.

In the embodiment, each sub-pixel with each color may include a filter layer for filtering the light to obtain the light with the pure color, and may include a switch, a capacitor and a liquid crystal layer to control the transmitted amount of light. In the following embodiment, how to implement the above-mentioned operation by the LCD apparatus in the image display system will be described.

Figure 3:
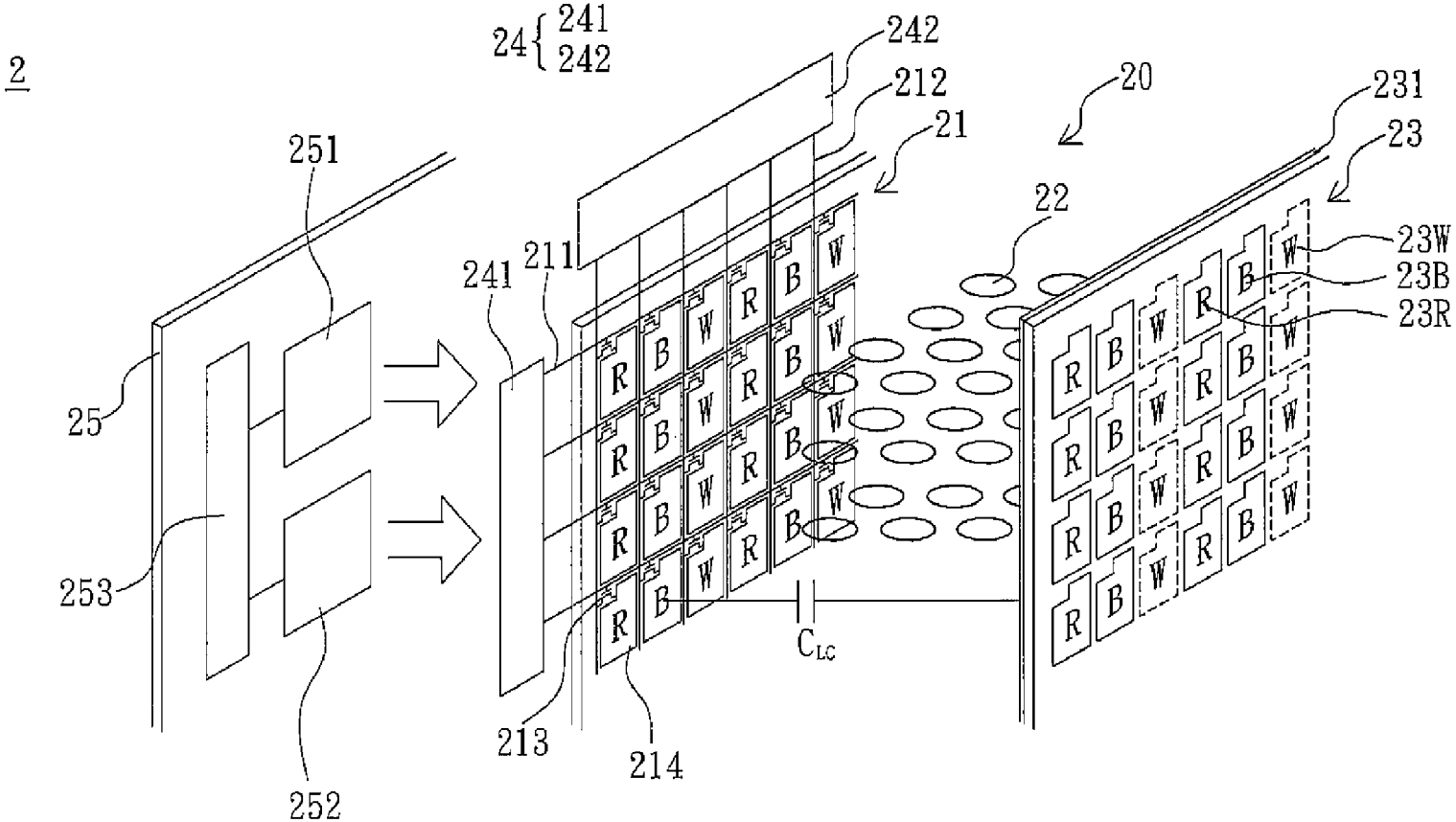
FIG. 3 is a schematic illustration showing a LCD apparatus according to the preferred embodiment of the invention.

FIG. 3 is a schematic illustration showing a LCD apparatus 2 according to a preferred embodiment of the invention. Referring to FIG. 3, the LCD apparatus 2 includes a LCD panel 20 and a backlight module 25. The LCD panel 20 includes a TFT substrate 21, a liquid crystal layer 22, a color filter substrate 23 and a liquid crystal driving circuit 24.

A plurality of scan lines 211 and a plurality of data lines 212 are formed on the TFT substrate 21. The scan lines 211 and the data lines 212 are alternately arranged in a matrix to define a plurality of array element regions.

A TFT 213 and a pixel electrode 214 are formed in each of the array element regions. The TFTs 213 and the pixel electrodes 214 in different array element regions correspond to the sub-pixels with one color. These TFTs 213 and these pixel electrodes 214 correspond to the red sub-pixel R, the blue sub-pixel B and the white sub-pixel W. In order to facilitate the recognition, symbols corresponding to the sub-pixels with this color are also marked on the pixel electrodes 214.

The array element regions corresponding to the red and blue colors on the color filter substrate 23 have red filter layers 23R and blue filter layers 23B. These color filter layers also correspond to the red sub-pixels R and the blue sub-pixels B, respectively. In addition, a filter-layer-free region 23W is provided at a position corresponding to the white sub-pixel W. One set of red, blue and white sub-pixels serves as a unitary pixel for displaying an image. In addition, it is to be specified that the filter-layer-free region in the white sub-pixel may be replaced with a white filter layer, through which the white light can pass similarly.

The liquid crystal layer 22 is disposed between the color filter substrate 23 and the TFT substrate 21. The tilt angle of the liquid crystal of the liquid crystal layer 22 is controlled by the voltage between two terminals (a common electrode 231 and the pixel electrode 214) of a liquid crystal storage capacitor $C_{LC}$.

The liquid crystal driving circuit 24 includes a scan line driver 241 and a data line driver 242, which are respectively electrically connected to the scan lines 211 and the data lines 212. The scan line driver 241 scans all scan lines 211 column-by-column during one frame time. During the period in which one scan line 211 is scanned, the data line 212 turns on the TFT 213 connected to the scanned scan line 211 and writes the data into the liquid crystal storage capacitor $C_{LC}$ of each pixel so as to control the tilt angle of the liquid crystal to adjust the transmitted amount of light.

In this architecture, the scan line driver 241 controls the TFTs 213 on each scan line 211 to turn on column-by-column during each frame time so that the data line driver 242 writes data into the pixel electrodes 214, and the potential difference between two electrodes of the liquid crystal storage capacitor $C_{LC}$ changes with the written data. Thus, the tilt angle of the liquid crystal is influenced and the amount of light penetrating through the color filter substrate 23 is adjusted. In addition, a polarizer (not shown) disposed between the TFT substrate 21 and the color filter substrate 23 cooperates with the liquid crystal to achieve the effect of controlling the amount of light.

In this embodiment, the backlight module 25 includes a white-light source 251, a green-light source 252 and a light source driving circuit 253, wherein the white-light source 251 and the green-light source 252 may be respectively implemented by a white-light diode and a green-light diode.

The light source driving circuit 253 continuously switches the white-light source 251 and the green-light source 252 during the frame time by turning off the green-light source 252 and timing on the white-light source 251 to generate the white light, and then turning off the white-light source 251 and turning on the green-light source 252 to generate the green light. Next, the light source driving circuit 253 turns off the green-light source 252 and turns on the white-light source 251 to generate the white light during another frame time, and the processes are performed in a cyclic manner.

During the same frame time, the white light first passes through the red filter layer 23R, the blue filter layer 23B and the filter-layer-free region 23W, and then the green light passes through the filter-layer-free region 23W. The filtered white light and green light form the image due to the persistence of vision of the human eyes.

Figure 4:
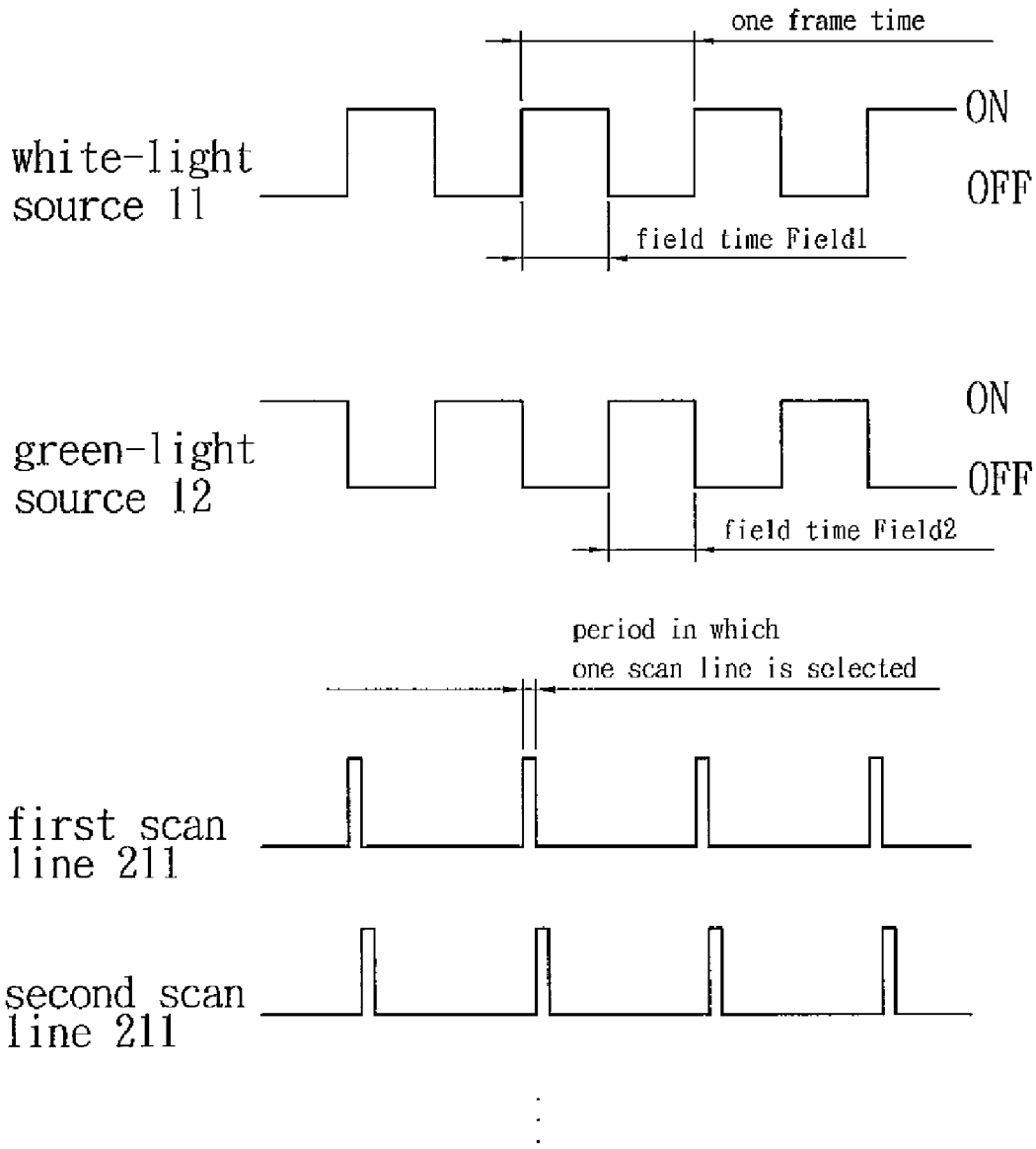
FIGS. 4 and 5 are timing charts showing timings during a frame time according to the preferred embodiment of the invention.

As shown in FIG. 4, the length of the frame time is equal to 1/60 seconds when the frequency of the frame time is 60 Hz. The frame time is divided into two field times Field1 and Field2 each having the frequency equal to 120 Hz, and a time length equal to 1/120 seconds. The white-light source 251 generates the white light during the field time Field1. The green-light source 252 generates the green light during the field time Field2. The white-light source 251 and the green-light source 252 are switched with the frequency equal to 120 Hz.

It is to be specified that the switching time instant of the light source is not in synchronization with the time instant of starting to turn on the scan line 211. As for the overall effect, however, the time lengths for which the white light and the green light illuminate are the same during the period when the liquid crystal storage Capacitors $C_{LC}$ on each scan line 211 holds the same data so that the green light can be compensated.

Figure 5:
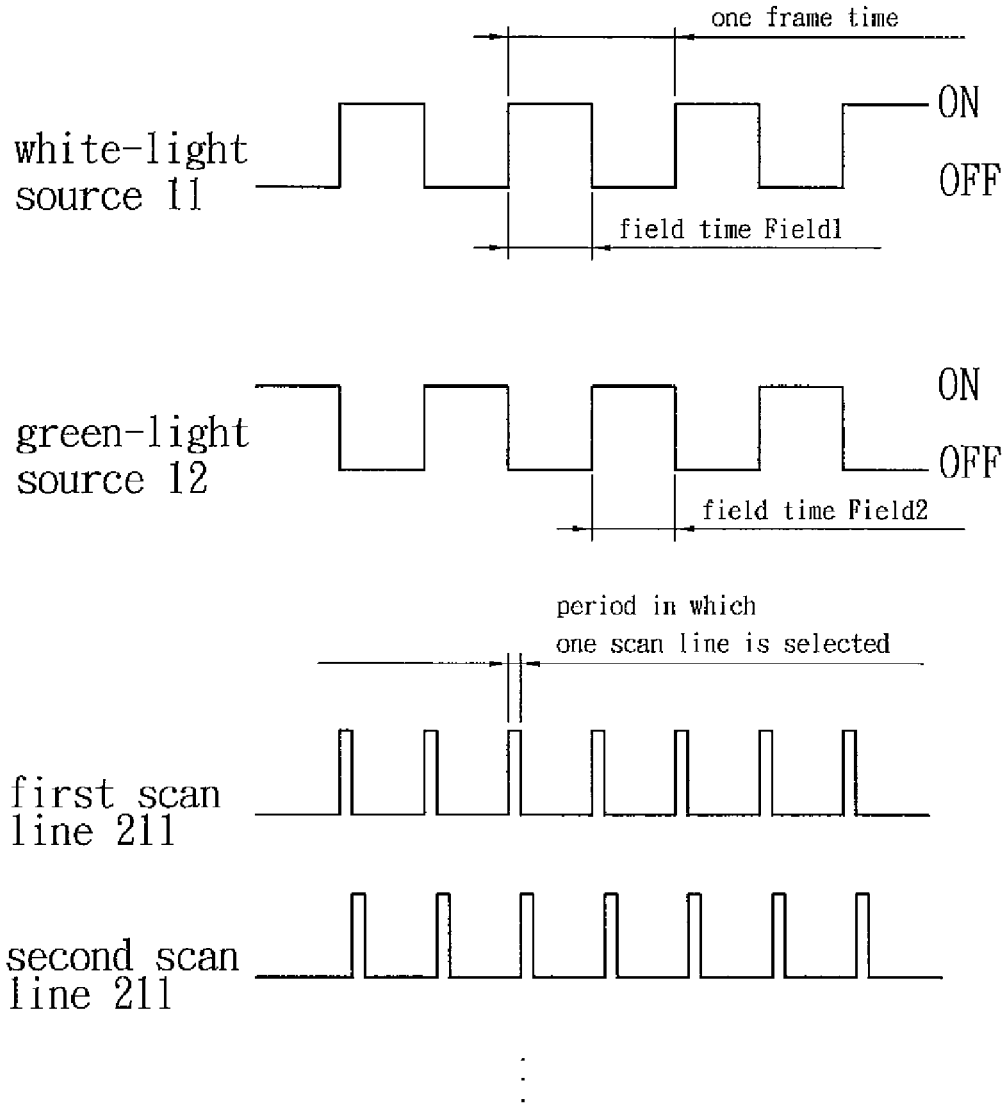

In addition, as shown in FIG. 5, the scan line driver 241 increases the scanning frequency so as to control each of the color sub-pixels to operate, respectively, in order to make the light passing through the filter layer have the purer color.

For example, all the scan lines 211, which are originally scanned during one frame time, are scanned during one field time. During the field time Field1, the light source driving circuit 253 turns on the white-light source 251 and turns off the green-light source 252 to generate the white light. Meanwhile, the scan line driver 241 turns on the TFTs 213 on all the scan lines 211 column-by-column, and the data lines 212 write the image data into the pixel electrodes 214 column-by-column.

Then, during the field time Field2, the light source driving circuit 253 turns on the green-light source 252 and turns off the white-light source 251 to generate the green light. Meanwhile, the scan line driver 241 turns on the TFTs 213 on all the scan lines 211 column-by-column, and the data lines 212 write, column-by-column, the image data into the pixel electrodes 214 respectively corresponding to the white sub-pixels W, and write the data of turning off the pixel into the pixel electrodes 214 respectively corresponding to the red sub-pixels R and the blue sub-pixels B.

The data of turning off the pixel corresponds to the operation of writing the fully dark data into the pixel electrode 214 so that the light cannot pass through the color filter substrate 23. The voltage of the fully dark data is determined according to the display type. For example, the data of turning off the pixel is a high voltage in the normal on display type, and the data of turning off the pixel is a low voltage in the normal off display type.

The drawback of the insufficient pure color of the green light in the prior art may be compensated and improved using the green-light source. So, the NTSC ratio can be increased without specifically increasing the thickness of each color filter layer. In addition, the conventional green sub-pixel in the unitary pixel is replaced with the white sub-pixel, so the transmitted amount of light can be increased and the image brightness can be increased therewith.

Figure 6:
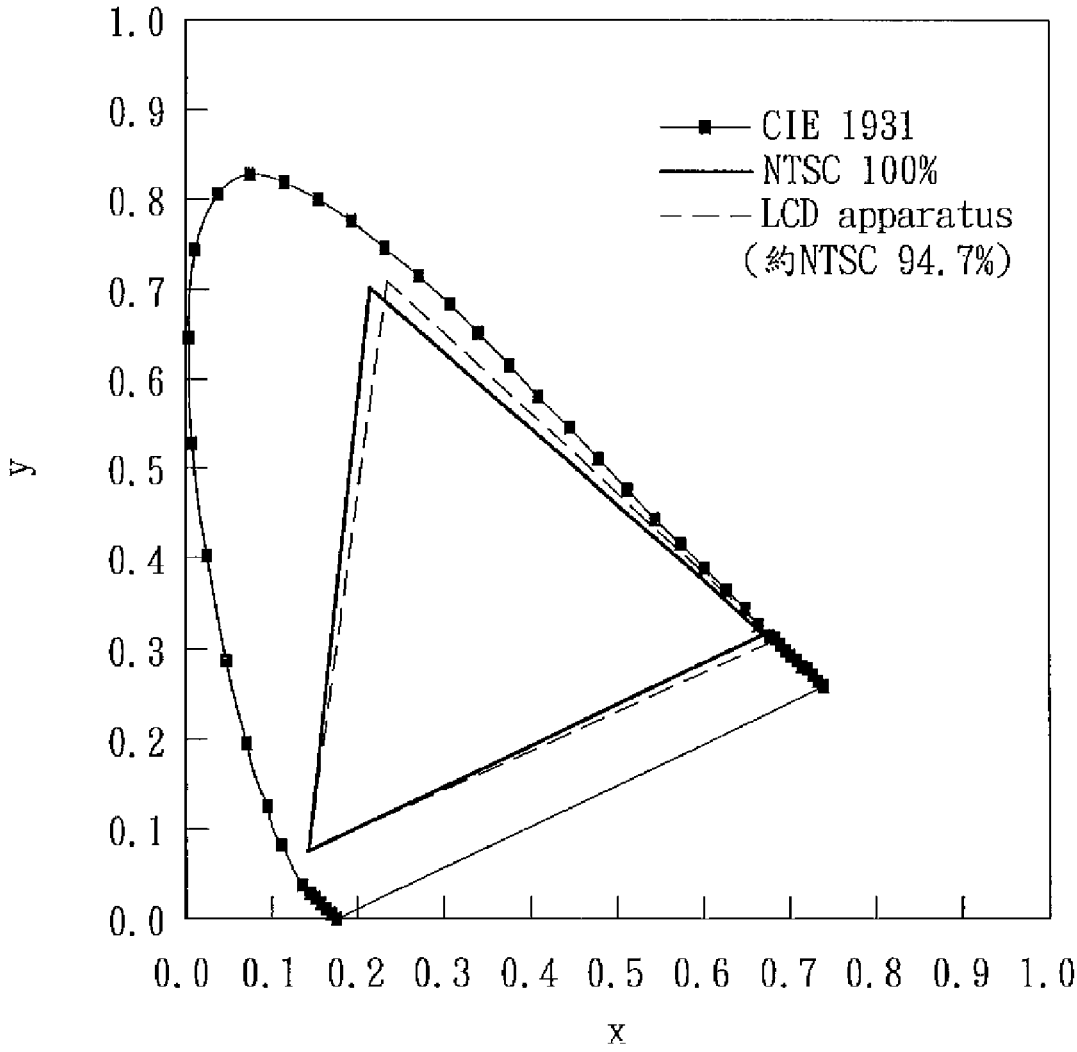
FIG. 6 shows a chromaticity diagram of a LCD apparatus according to the preferred embodiment of the invention.

In this embodiment, if the red filter layer 23R and the blue filter layer 23B have the thickness equal to 2.5 microns and cooperate with the light source switching operations, the NTSC ratio of the image display system 1 may be increased to 94.7%, as shown in FIG. 6.

Figure 7:
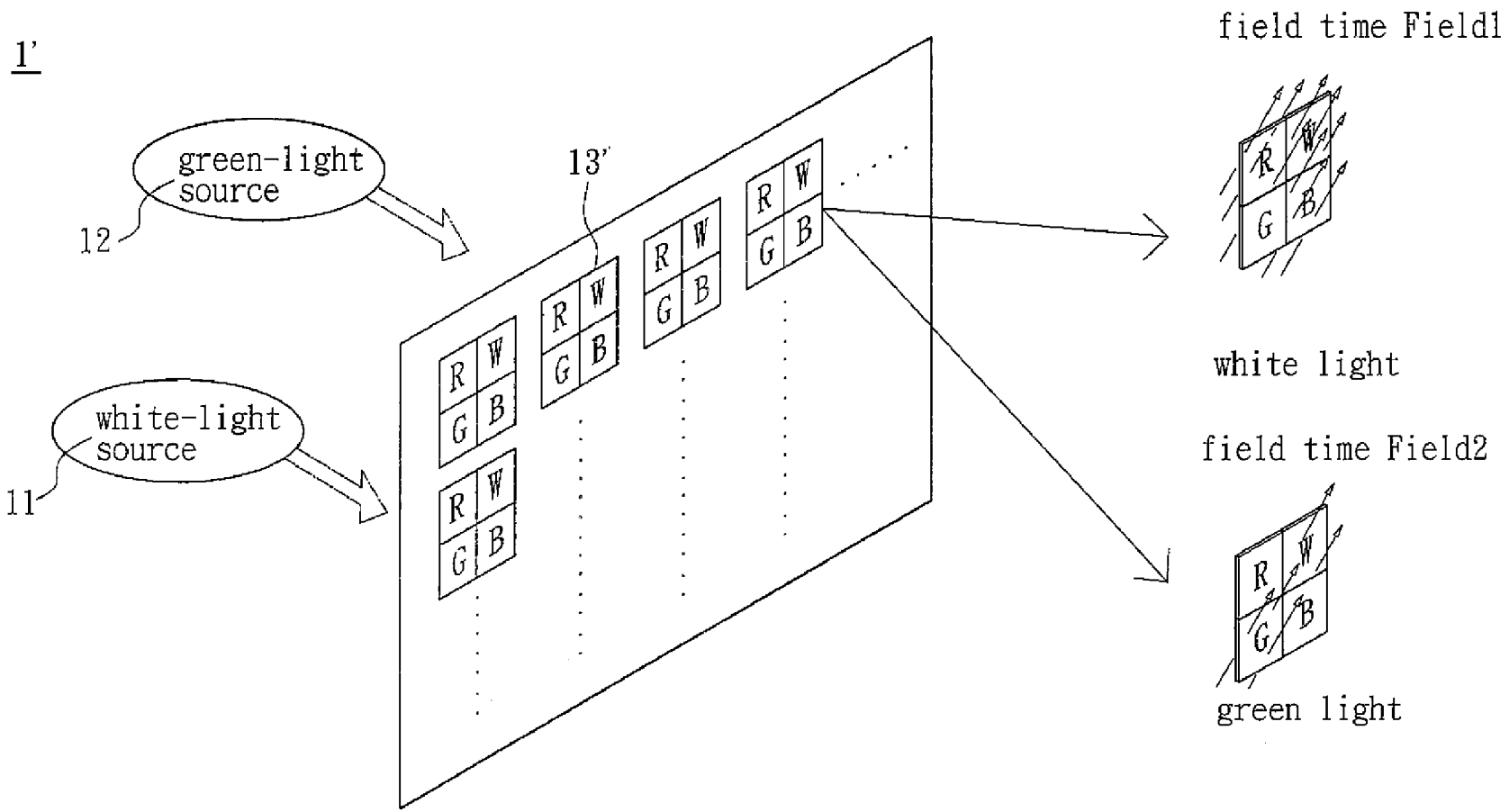
FIG. 7 is a schematic illustration showing another image display system according to the preferred embodiment of the invention.

FIG. 7 is a schematic illustration showing another image display system 1' according to a preferred embodiment of the invention. The difference between FIGS. 7 and 2 is that one unitary pixel 13' includes a red sub-pixel R, a blue sub-pixel B and a white sub-pixel W, and Her includes a green sub-pixel G. The sub-pixels with different colors in one unitary pixel 13' are arranged in a rectangle, and each of the sub-pixels with the different colors occupies one corner.

In this embodiment, one frame time is divided into two field times Field1 and Field2. During the field time Field1, the white-light source 11 generates the white light, while the red sub-pixel R, the blue sub-pixel B and the white sub-pixel W are turned on and the green sub-pixel G is turned off. During the field time Field2, the green-light source 12 generates the green light, while the red sub-pixel R and the blue sub-pixel B are turned off and only the white sub-pixel W and the green sub-pixel G are turned on. Thus, when the green-light source 12 operates, the purer green light can be generated.

Figure 8:
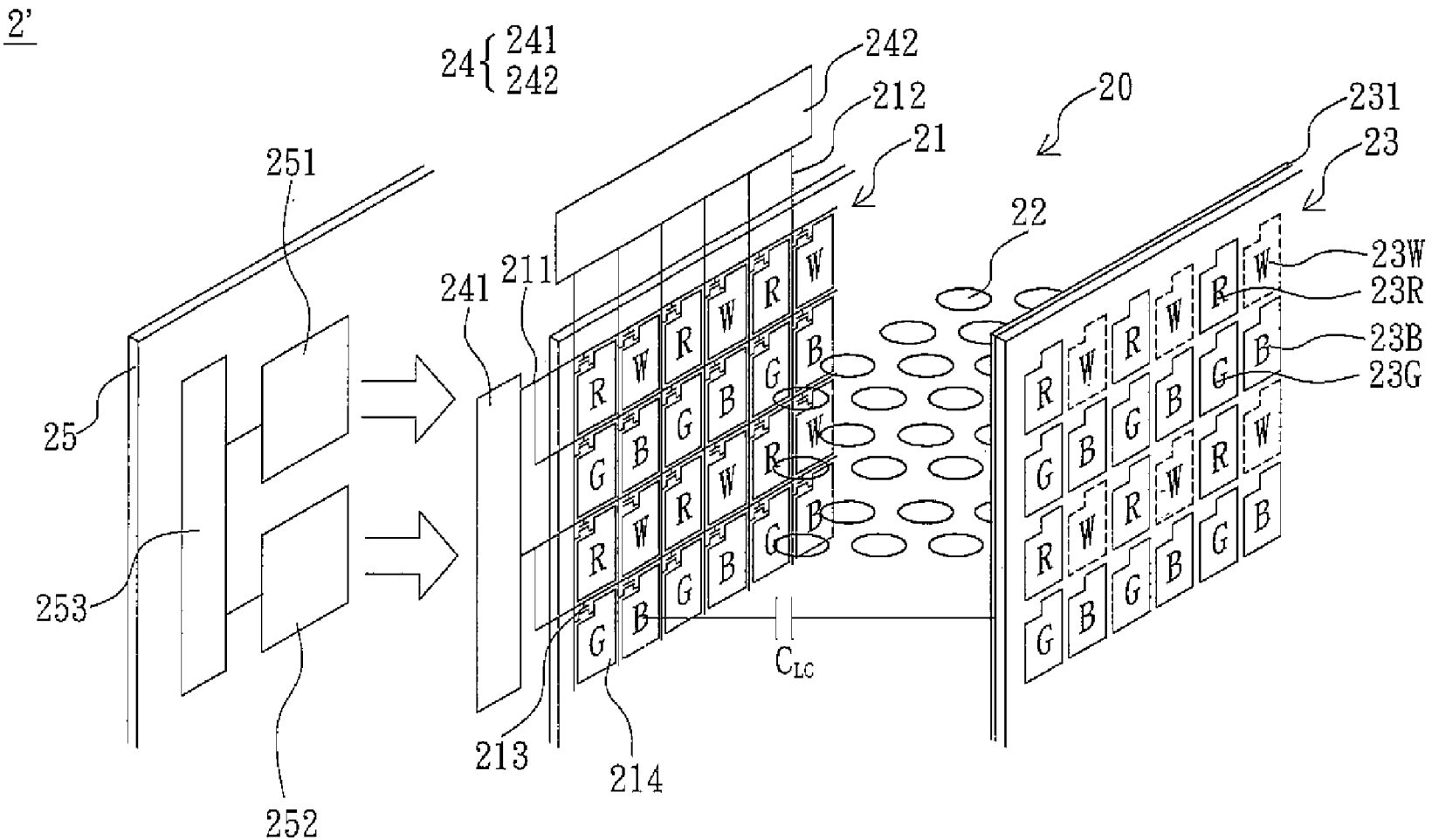
FIG. 8 is a schematic illustration showing another LCD apparatus according to the preferred embodiment of the invention.

In the following embodiment how to implement the above-mentioned operations using the LCD apparatus in the image display system will be described. FIG. 8 is another schematic illustration showing the LCD apparatus according to the preferred embodiment of the invention. As shown in FIG. 8, what is different from FIG. 3 is that green filter layers 23G corresponding to the green sub-pixels G are disposed on the color filter substrate 23, and that the red filter layer 23R, the blue filter layer 23B and the green filter layer 23G are disposed in one rectangle and respectively occupy three corners of the rectangle, while the other corner is provided with the filter-layer-free region 23W corresponding to the white sub-pixel W.

In this embodiment, if the LCD apparatus 2' displays the low-saturation image, the light source driving circuit 253 turns off the green-light source 252 and turns on the white-light source 251 to generate the white light, and the scan line driver 241 and the data line driver 242 update, column-by-column, the data to the liquid crystal storage capacitors $C_{LC}$ to display the image. In this operation mode, the data line driver 242 does not write the data of turning off the pixel to each pixel electrode 214, so each sub-pixel is not turned off.

In addition, when the LCD apparatus 2' displays the high-saturation image, one frame time is divided into two field times Field1 and Field2 and the image is displayed in two parts, which is similar to the embodiment of FIG. 3.

During the field time Field1, the light source driving circuit 253 turns on the white-light source 251 and turns off the green-light source 252 to generate the white light. Meanwhile, during the field time Field1, the scan line driver 241 turns on the TFTs 213 on all the scan lines 211 column-by-column, and the data line driver 242 writes, column-by-column, the image data to the pixel electrodes 214 respectively corresponding to the red sub-pixel R, the blue sub-pixel B and the white sub-pixel W, and writes the data of turning off the pixel into the pixel electrodes 214 respectively corresponding to the green sub-pixels G in order to turn off the green sub-pixels G. Thus, the white light passing through the red filter layer 23R and the blue filter layer 23B and corresponding to the filter-layer-free region 23W of the white sub-pixel W may pass through the polarizer.

During the field time Field2, the light source driving circuit 253 turns on the green-light source 252 and turns off the white-light source 251 to generate the green light. Meanwhile, the scan line driver 241 turns on the TFTs 213 on all the scan lines 211 column-by-column, and the data lines 212 write, column-by-column, the image data into the pixel electrodes 214 corresponding to the white sub-pixel W and the green sub-pixel Q and write the data of turning off the pixel into the pixel electrodes 214 corresponding to the red sub-pixel R and the blue sub-pixel B in order to turn off the red sub-pixel R and the blue sub-pixel B. Thus, the green light passing through the green filter layer 23G and the filter-layer-free region 23W can pass through the polarizer.

In this embodiment, if the red filter layer 23R, the blue filter layer 23B and the green filter layer 23G have the thickness equal to 2.0 microns and cooperate with the light source switching operations, the NTSC ratio of the image display system may also be increased to 94.7%, as shown in FIG. 6.

Figure 9:
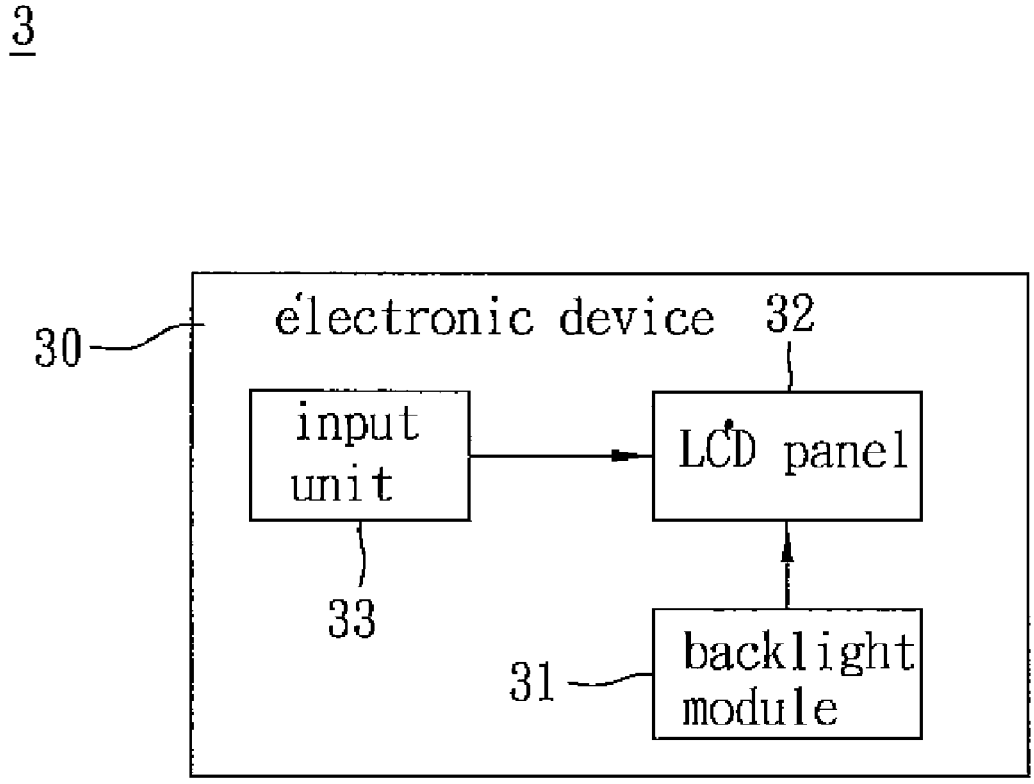
FIG. 9 is a block diagram showing the image display system according to the preferred embodiment of the invention.

FIG. 9 is a block diagram showing an image display system 3 according to a preferred embodiment of the invention. Referring to FIG. 9, the image display system 3 includes an electronic device 30, which has a backlight module 31, a LCD panel 32 and an input unit 33. The backlight module 31 and the LCD panel 32 of this embodiment of FIG. 9 and the backlight module 25 and the LCD panel 20 of the embodiment of FIG. 3 have the same structures, functions and effects, and various implementations thereof have been described in the above-mentioned embodiment.

The backlight module 31 outputs light to the LCD panel 32, and the input unit 33 is coupled to the LCD panel 32 and provides an input to the LCD panel 32 to make the LCD panel 32 display the image. The electronic device 30 is a mobile phone, a digital camera, a personal digital assistant, a notebook computer, a desktop computer, a television, a vehicle display, a head mounted display, a printer screen, a MP3 player, a hand-held playstation or a portable DVD player.

In summary, the generated white light passes through the red, blue and white sub-pixels but the generated green light cannot pass through the red and blue sub-pixels but only can pass through the white sub-pixel during the same frame time in the image display system and method according to the invention. Thus, the insufficiently pure color of the green light can be compensated so that the formed image has the higher NTSC ratio and the better color can be displayed. In addition, the brightness of the image may also be increased so that the better display effect can be achieved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An image display comprising:

a white-light source for generating white light during a frame time;

a green-light source for generating green light during the frame time;

a plurality of pixels disposed corresponding to the white-light source and the green-light source, wherein each of the pixels has a red sub-pixel, a blue sub-pixel and a white sub-pixel; and a color filter substrate having a plurality of red filter layers and a plurality of blue filter layers respectively corresponding to the red sub-pixels and the blue sub-pixels, and having a plurality of filter-layer-free regions corresponding to the white sub-pixels, wherein the red sub-pixels, the blue sub-pixels and the white sub-pixels are turned on to let the white light pass through, and then the red sub-pixels and the blue sub-pixels are turned off while the white sub-pixels are turned on to let the green light pass through to form an image during the frame time; and wherein a length of the frame time is equal to 1/60 seconds, the white-light source generates the white light for a time length equal to 1/120 seconds, and the green-light source generates the green light for a time length equal to 1/120 seconds.

2. The image display system according to claim 1, wherein the white-light source and the green light generate the light unsimultaneously during the frame time.

3. The image display system according to claim 1, wherein a thickness of each of the red filter layers and the blue filter layers is greater than or equal to 2.5microns.

4. The image display system according to claim 1, wherein each of the pixels further has a green sub-pixel.

5. The image display system according to claim 4, wherein the green sub-pixels are turned off and the red sub-pixels, the blue sub-pixels and the white sub-pixels are turned on to let the white light pass through, and then the red sub-pixels and the blue sub-pixels are turned off while the white sub-pixels and the green sub-pixels are turned on to let the green light pass through to form an image during the frame time.

6. The image display system according to claim 4, further comprising:

a color filter substrate having a plurality of red filter layers, a plurality of blue filter layers and a plurality of green filter layers respectively corresponding to the red sub-pixels, the blue sub-pixels and the green sub-pixels, and having a plurality of filter-layer-free regions corresponding to the white sub-pixels.

7. The image display system according to claim 6, wherein a thickness of each of the red filter layers, the blue filter layers and the green filter layers is greater than or equal to 2.0 microns.

8. The image display system according to claim 1, wherein the white-light source and the green-light source are respectively a white-light diode and a green-light diode.

9. The image display system according to claim 1, further comprising:

a liquid crystal display (LCD) panel; and a backlight module, wherein the white-light source and the green-light source are disposed in the backlight module, and the backlight module outputs the white light and the green light to make the LCD panel display an image.

10. The image display system according to claim 9, further comprising:

a liquid crystal display (LCD) apparatus having the backlight module and the LCD panel, wherein the backlight module outputs the light to the LCD panel to make the LCD panel display the image.

11. The image display system according to claim 1, further comprising:

an electronic device having a backlight module, a LCD panel and an input unit, wherein the backlight module outputs light to the LCD panel, the input unit is coupled to the LCD panel and inputs signals to the LCD panel to make the LCD panel display an image.

12. The image display system according to claim 11, wherein the electronic device is a mobile phone, a digital camera, a personal digital assistant, a notebook computer, a desktop computer, a television, a vehicle display or a portable DVD player.

13. An image display method, comprising the steps of:

generating white light passing through a red sub-pixel, a blue sub-pixel and a white sub-pixel of a plurality of pixels during a frame time;

generating green light passing through the white sub-pixel of the pixels to form an image during the frame time, wherein the red sub-pixels and the blue sub-pixels respectively correspond to a plurality of red filter layers and a plurality of blue filter layers of a color filter substrate, and the white sub-pixels correspond to a plurality of filter-layer-free regions of the color filter substrate, and wherein the red sub-pixels, the blue sub-pixels and the white sub-pixels are turned on to let the white light pass through, and then the red sub-pixels and the blue sub-pixels are turned off while the white sub-pixels are turned on to let the green light pass through to form an image during the frame time; and wherein a length of the frame time is equal to 1/60 seconds, the white-light source generates the white light for a time length equal to 1/120 seconds, and the green-light source generates the green light for a time length equal to 1/120 seconds.

14. The method according to claim 13, wherein the white-light source and the green light generate the light unsimultaneously during the frame time.

15. The method according to claim 13, during the frame time, wherein:

the step of generating the white light comprises turning on the red sub-pixels, the blue sub-pixels and the white sub-pixels to let the white light pass through; and the step of generating the green light comprises turning off the red sub-pixels and the blue sub-pixels and turning on the white sub-pixels to let the green light pass through so as to form the image.

* * * * *